US006055838A

United States Patent [19]

Ohama et al.

[11] Patent Number: 6,055,838

[45] Date of Patent: May 2, 2000

[54] METHOD OF FORMING OUTER RING OF CONSTANT VELOCITY JOINT

[75] Inventors: Tsukashi Ohama; Tomonori Nakamura, both of Utsunomiya; Mikio Kobayashi, Tochigi-ken; Yuichi Nagao, Omiya; Yoshihisa Doi, Utsunomiya, all of Japan

[73] Assignee: Honda Giken Kogyo Kabushiki Kaisha, Tokyo, Japan

[21] Appl. No.: 09/217,926

[22] Filed: Dec. 22, 1998

[30] Foreign Application Priority Data

Dec. 22, 1997 [JP] Japan ..... 9-353292

[51] Int. Cl.[7] ..... B21D 22/00

[52] U.S. Cl. ..... 72/356; 72/352

[58] Field of Search ..... 72/353.4, 353.6, 72/358, 359, 398, 354.2, 344, 345, 356, 352

[56] References Cited

U.S. PATENT DOCUMENTS 4,601,191 7/1986 Ikeda et al. ..... 72/358
4,967,584 11/1990 Sato et al. ..... 72/356

*Primary Examiner*—Rodney A. Butler

[57] ABSTRACT

A forge-molding method for forming a constant velocity joint outer ring comprising a shaft and a cup formed integral with and expanding radially and outwardly from one end of the shaft is provided. The method uses an ironing die apparatus which is provided with a lower molding die, an upper molding die and an ironing punch. The lower molding die is provided with a first cavity formed to have a final degree of product accuracy with respect to the shaft and adapted to apply a final ironing process to the shaft, while the upper molding die is provided with a second cavity for restraining the outer peripheral surface of the cup. Consequently, the accuracy of concentricity between the shaft and the cup can be securely maintained in a simple manner and a sufficient degree of accuracy of the inner peripheral surface and/or the inner diameter of the cup can be effectively secured.

3 Claims, 8 Drawing Sheets

2

6
2a
4
FIRST STEP 6a
8
4
SECOND STEP 6b
10
4
THIRD STEP 70
74
72
80
FOURTH STEP

14
12
4
BACKGROUND ART
BACKGROUND ART
BACKGROUND ART
BACKGROUND ART
BACKGROUND ART

METHOD OF FORMING OUTER RING OF CONSTANT VELOCITY JOINT

BACKGROUND OF THE INVENTION

1. Field of the Invention

The present invention relates to a method of forming an outer ring of a constant velocity joint which outer ring comprises a shaft and a cup formed integral with and expanding radially and outwardly of one end of the shaft.

2. Description of the Related Art

In the power transmission of an automobile, for example, there is employed a constant velocity joint in order that a smooth torque may be obtained without being affected by the angle of orientation of the shaft to be driven. As constant velocity joints of this kind, there are known a Birfield type joint which transmits a torque by means of a ball bearing and a tripod type joint which transmits a torque through at least three rollers.

In the above case, each of the Birfield type and tripod type constant velocity joints is provided with an outer ring (outer member) comprising a shaft and a cup formed integral with the shaft and extending radially and outwardly of one end of the shaft and having a plurality of track grooves on the inner peripheral surface thereof.

Where, for example, the outer ring which forms part of the Birfield type constant velocity joint is manufactured, a rod-shaped material 2 is prepared as shown in FIG. 8A and a molded body 6 having a shaft portion 4 and a solid body portion 2*a* is obtained by subjecting the material 2 to forward extrusion molding (refer to FIG. 8B). Next, as shown in FIG. 8C, by applying an upsetting process to the molded body 6, the solid body portion 2a is extruded to form an upset portion 8 and then the upset portion 8 is extrusion-molded to thereby form a cup portion 10 (refer to FIG. 8D). Further, as shown In FIG. 8E, an ironing (sizing) process is applied to the inner peripheral surface of the cup portion 10 so that an outer ring member 14 as a product having a plurality of track grooves 12 is obtained.

In the above described forming process, the shaft portion 4 is set to have a predetermined degree of product accuracy by being extrusion-molded to a comparatively large length In the axial direction through the forward molding process shown in FIG. 8B. On the other and, the cup portion 10 is formed by a plurality of forming processes including upset molding, backward extrusion molding and ironing processes as shown in FIGS. 8C through 8E.

Thus, the processes for forming the shaft portion 4 and the cup portion 10 are performed separately from one another and particularly, the cup portion 10 is formed by a plurality of molding processes so that the lowering of the level of accuracy due to a die accuracy error or the abrasion of the die in each of the processes tends to take place. Consequently, the problem Is being pointed out that the accuracy of concentricity between the shaft portion 4 and the cup portion 10 formed In advance by the forward extrusion molding can not be secured and processes for obtaining the roundness of the inner peripheral surface of the cup portion 10 and the concentricity of the cup with the shaft 4 become necessary before grinding the track grooves 12 and the inner peripheral surface of the cup portion 10, which results in requiring many man-hours. Further, a problem also arises that many man-hours are required to perform a grinding process for securing the product accuracy with respect to the track grooves 12 and the inner spherical surface of the cup portion 10.

SUMMARY OF THE INVENTION

A principal object of the present invention is to provide a method of forge-molding an outer ring of a Th constant velocity joint which method is capable of effectively securing the accuracy of concentricity between a shaft and a cup forming the outer ring in a simple manner and performing a molding process as a whole for the outer ring efficiently and easily.

The above and other objects, features and advantages of the present invention will become more apparent from the following description when taken in conjunction with the accompanying drawings in which a preferred embodiment of the present invention is shown by way of an illustrative example.

DESCRIPTION OF A PREFERRED EMBODIMENT

Figure 1:
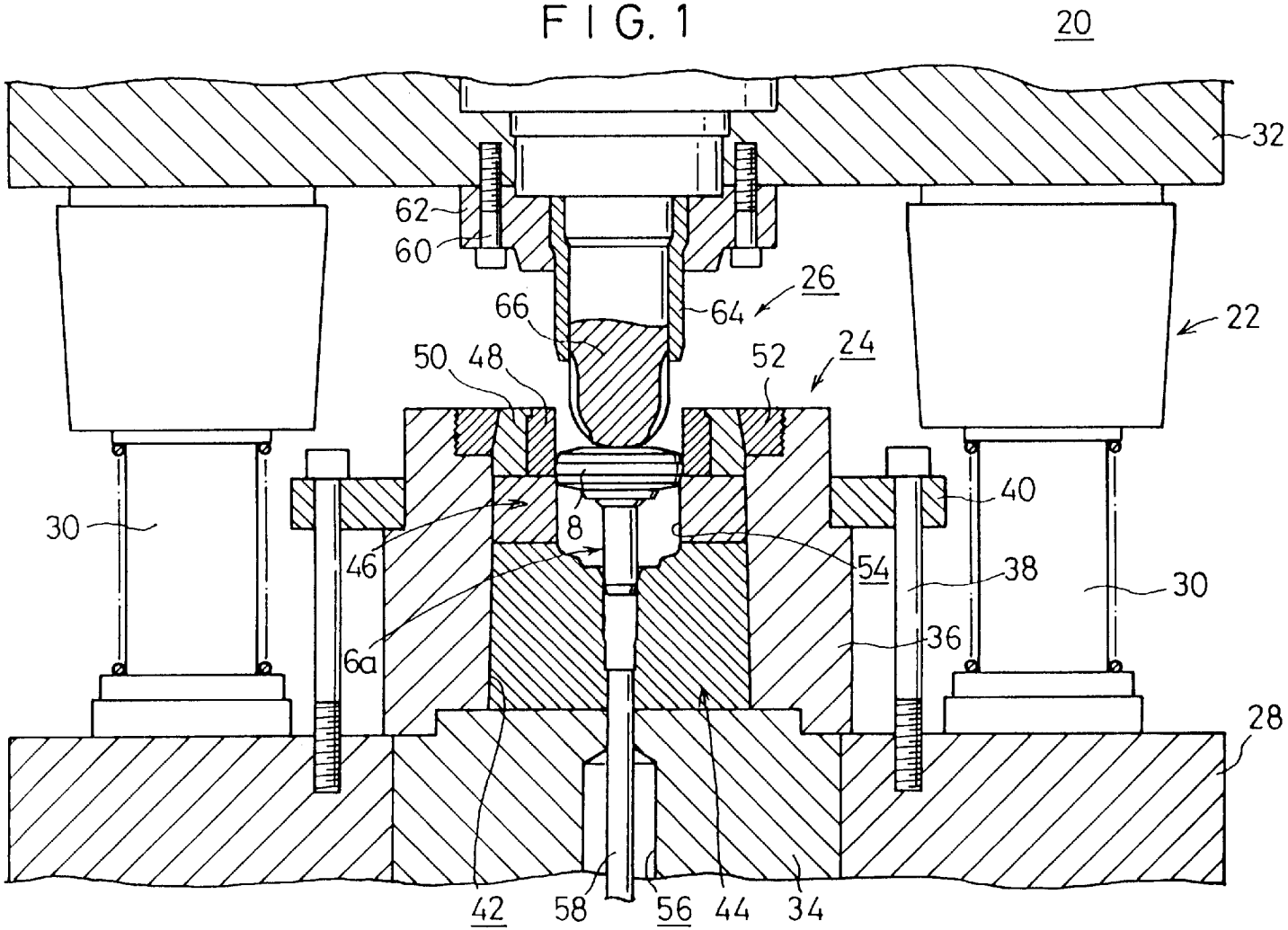
FIG. 1 is an illustrative vertical sectional view of a molding apparatus for performing a rearward extrusion molding process used in a forge-forming method according to one embodiment of the present invention.

FIG. 1 is an illustrative vertical sectional view of a molding apparatus 20 used for performing a rearward extrusion molding process (to be described later) in carrying out a forge-forming method according to one embodiment of the present invention. The molding apparatus 20 is provided with a lower die 24 and an upper die 26 to be mounted in a die set 22, and the die set 22 is provided with a lower shoe 28 and an upper shoe 32 capable of moving up and down through a guide pin 30 with respect to the lower shoe 28.

The lower die 24 has a die holder 34 assembled into the lower shoe 28 and on the die holder 34 a press-in ring 36 is retained through bolts 38 screw-fitted into the lower shoe 28 and a fixing plate 40. Into a tapered hole 42 of the press-in ring 36 there are integrally press-fitted a lower molding die 44 and an upper molding die 46, and onto this upper molding die 46 there are fixed first and second rings 48 and 50 through a tightening ring 52 to be screwed into the press-in ring 36. Further, a cavity 54 extending continuously from the lower molding die 44 up to the upper molding die 46 is constituted with the lower end of the cavity 54 being held in communication with a hole 56 formed within the die holder 34, and a knockout pin 58 is disposed within the hole 56 so as to move up and down through the hole 56.

The upper die 26 has a holder 62 fixed to the upper shoe 32 by means of bolts 60 and a forming punch 66 is retained by the holder 62 through a punch sleeve 64. The punch sleeve 64 has the function of guiding a forming punch 66 by sliding along the first ring 48 and the top end of the forming punch 66 is set to a configuration substantially corresponding to that of a cup 74 to be described later.

Figure 2:
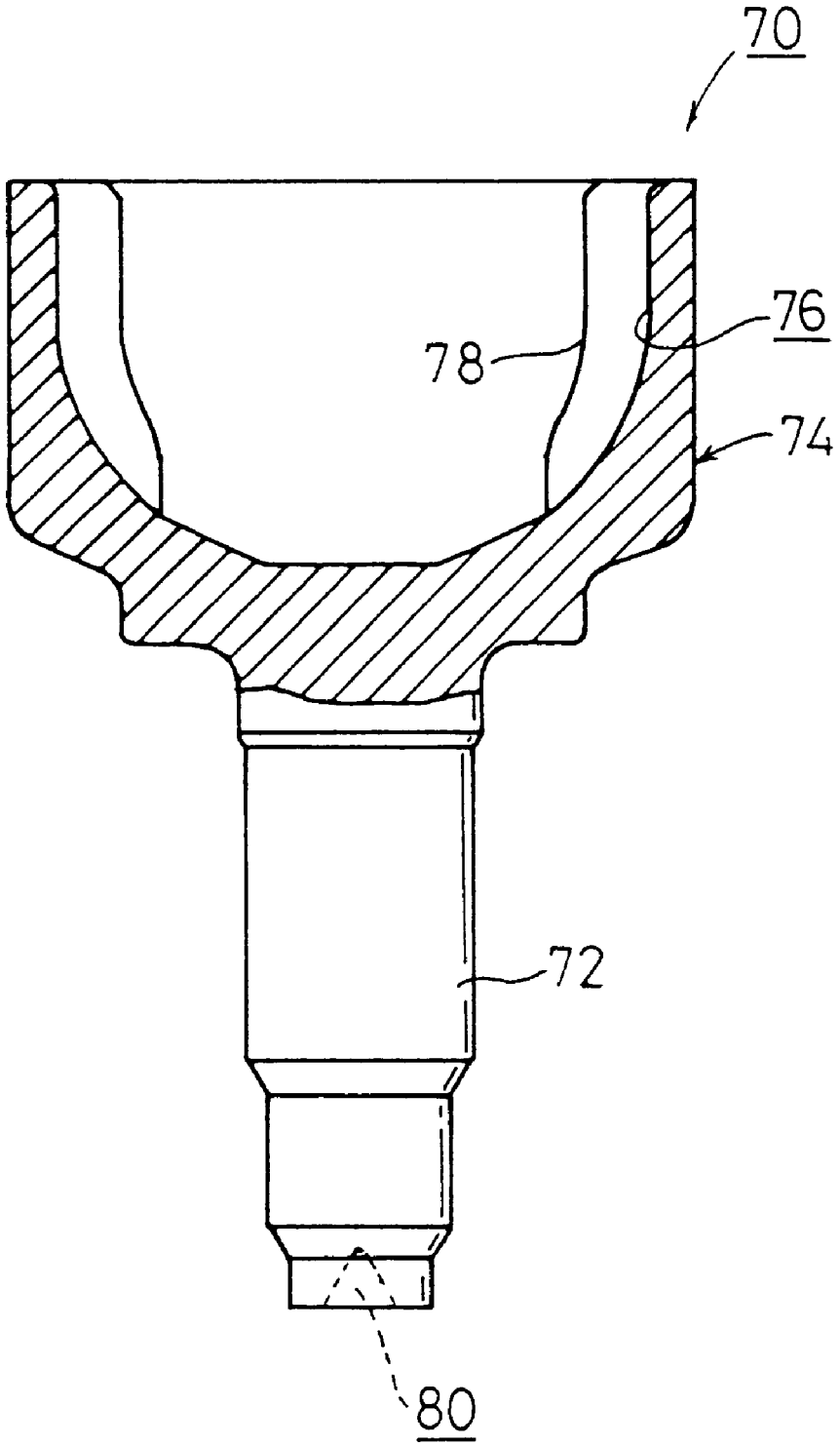
FIG. 2 is an illustrative view (partly in section) of an outer ring member to be manufactured by the forge-molding method according to the present invention.

An outer ring 70 formed by the forge-molding method according to the instant embodiment comprises a shaft 72 and the cup 74 formed integral with each other as shown in FIG. 2. The cup 74 includes an under-cut portion expanding radially and outwardly from one end of the shaft 72 as shown in FIG. 2. On the inner spherical surface of the cup 74 there are provided a plurality of (for example, six) ball grooves 76 equi-angularly spaced apart from one another through ridge line portions 78. The other end of the shaft 72 is provided with a central hole 80.

Figure 3:
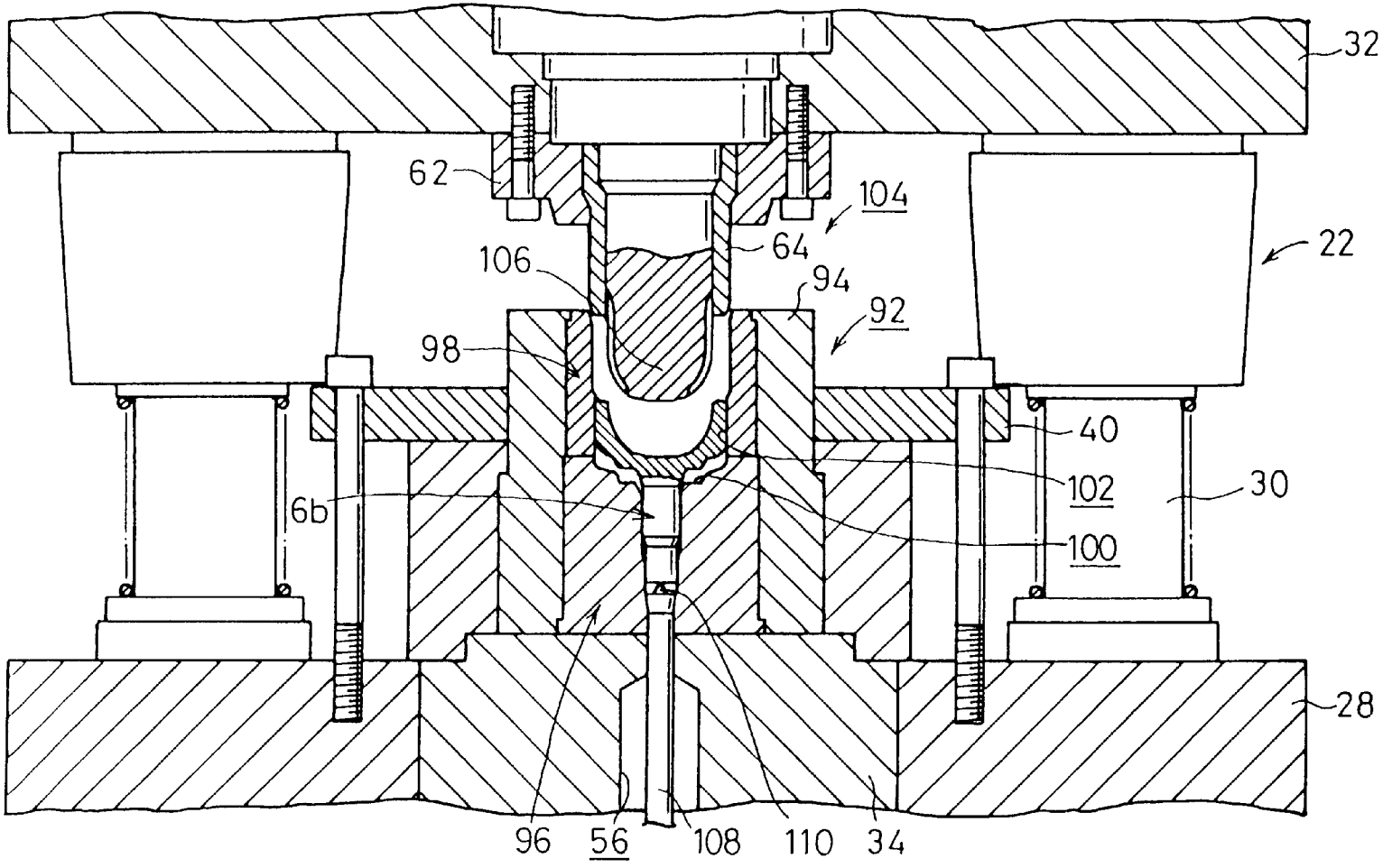
FIG. 3 is an illustrative vertical sectional view of an ironing die apparatus for carrying out the forge-molding method according to the present invention.

FIG. 3 is an illustrative vertical sectional view of an ironing die apparatus 90 for obtaining the outer ring 70 by applying a final ironing process to a molded product (to be described later) after performing a rearward extrusion molding process by the molding apparatus 20. It should be noted that in FIG. 3, the same structural elements as those of the molding apparatus 20 are designated by the same reference numerals while omitting a detailed description thereof.

A lower die 92 forming part of the ironing die apparatus 90 is provided with a lower molding die (first molding portion) 96 and an upper molding die (second molding portion) 98 to be press-fitted into, and fixed to, a retaining ring 94. The lower molding die 96 is formed to have a final product accuracy with respect to the shaft 72 of the outer ring 70 and forms itself a first cavity 100 for subjecting the shaft 72 to a final ironing process while the upper molding die 98 is formed to have a final product accuracy with respect to the cup 74 of the outer ring 70 and forms itself a second cavity 102 for restraining the outer surface of the cup 74. The first and second cavities 100 and 102 continuously and integrally define the outer configuration of the outer ring 70. It should be noted that a single die may be used to substitute the lower molding die 96 and the upper molding die 98.

The upper die 104 which forms the ironing die apparatus 90 is provided with an ironing punch 106 for ironing the inner circumferential portion of the cup 74 simultaneously with the final ironing of the shaft 72 in a state in which the outer periphery of the cup 74 is restrained by the upper molding die 98 and the lower molding die 96. The top end of a knockout pin 108 arranged in the die holder 34 so as to move forward and rearward is provided with a punching portion 110 for forming the central hole 80 in the shaft 72.

Next, a forge-molding method for manufacturing the outer ring 70 in accordance with the instant embodiment will be described.

Figures 4A, 4B, 4C, 4D, 4E:
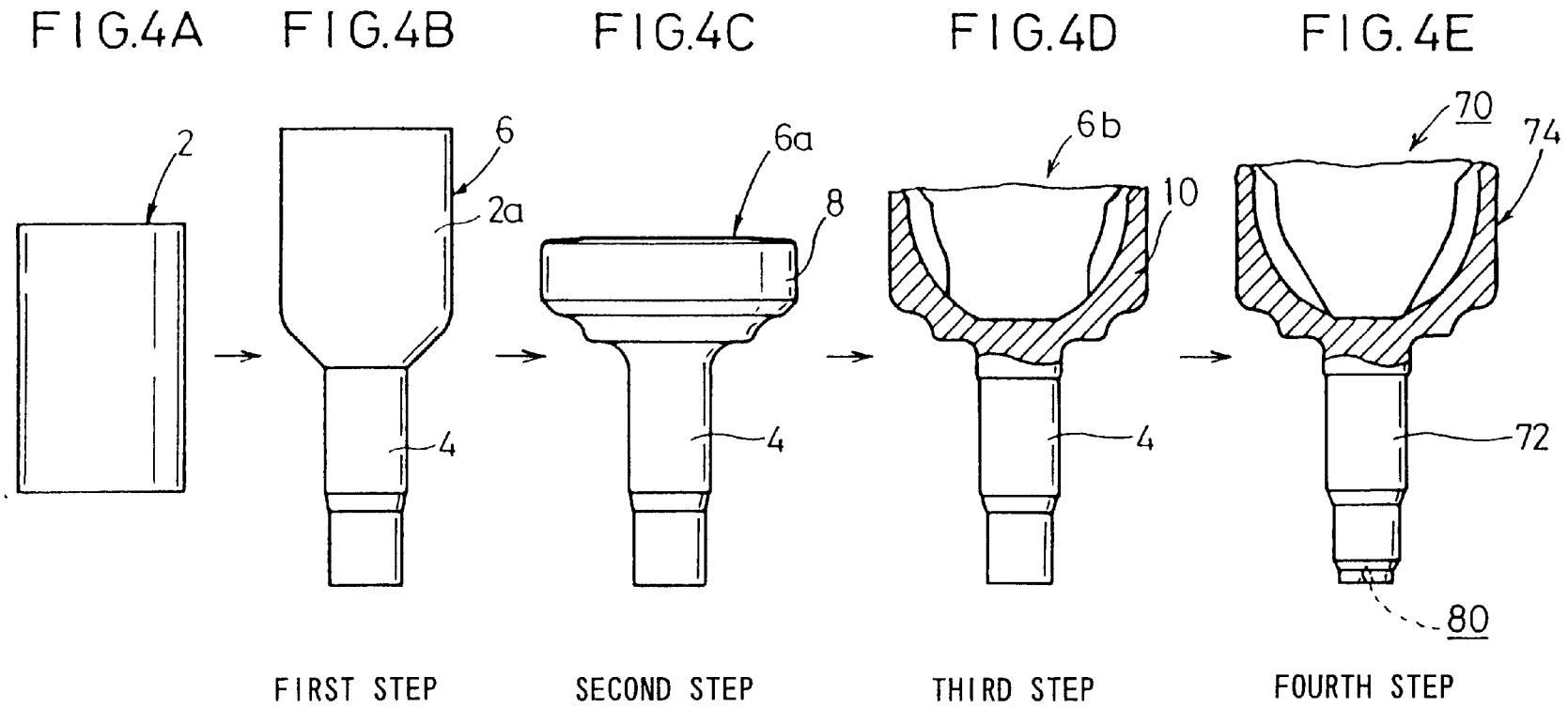
FIGS. 4A through 4E are views respectively illustrating processes of the forge-molding method according to the present invention.

First, when a cylindrical rod-shaped material 2 shown in FIG. 4A is subjected to a forward extrusion molding process, a shaft portion 4 is extruded and a molded body 6 is integrally formed by the shaft portion 4 and a solid main body 2*a* as shown in FIG. 4B (First step). Next, as shown in FIG. 4C, when the molded body 6 is subjected to an upset molding process, the solid main body 2*a* is crushed to form an upset portion 8 (Second step). An intermediate molded body 6*a* having the upset portion 8 formed therewith is then subjected to a rearward extrusion molding process by the molding apparatus 20 (Third step).

Figure 5:
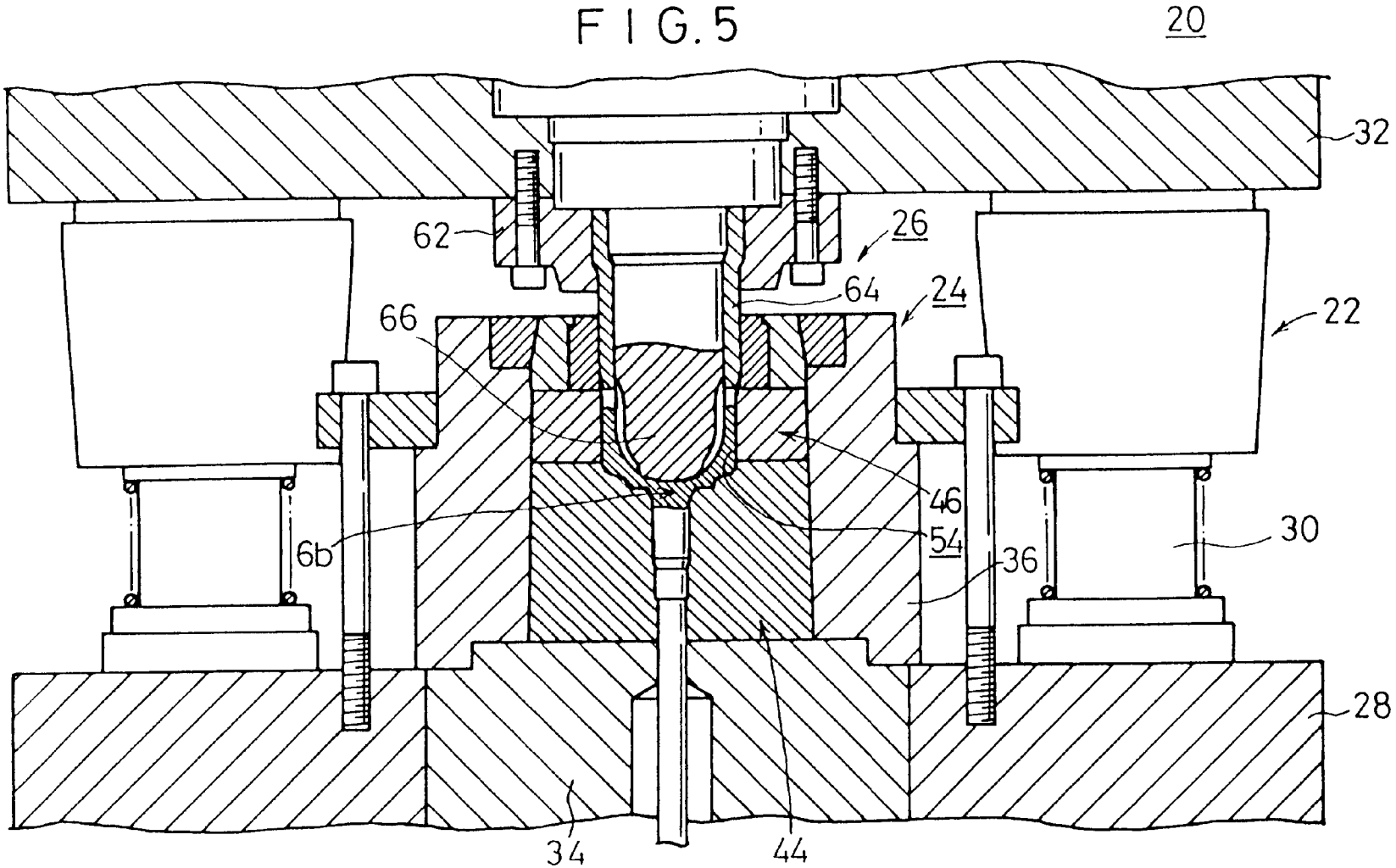
FIG. 5 is an illustrative vertical sectional view of the molding apparatus especially when a rearward extrusion molding process is performed by the molding apparatus.

That is, in the molding apparatus 20, the intermediate molded body 6*a* is disposed in the cavity 54 in a state in which a molding punch 66 is arranged integrally with the upper shoe 32 at the upper portion of the apparatus as shown in FIG. 1. Then, the molding punch 66 moves down integrally with the upper shoe 32 and by a cooperative operation among the molding punch 66, the upper molding die 46 and the lower molding die 44, a cold forge-molding process for the intermediate molded body 6*a* is started so that the solid main body 2*a* of the intermediate molded body 6*a* moves plastically in conformity with the configuration of the cavity 54. Consequently, a molded product 6b provided with the ball grooves 76 on the inner peripheral surface thereof and the cup portion 10 having a configuration substantially corresponding to the ridge line portions 78 is molded. (refer to FIG. 4D and FIG. 5).

In this case, the knockout pin 58 displaces toward the cavity 54 after the molding punch 66 has moved upward and the molded product 6*b* which has been molded within the cavity 54 is taken out. Thus, the third step is completed as shown in FIG. 4D and the molded product 6*b* shifts to a fourth step as shown in FIG. 4D.

Figure 6:
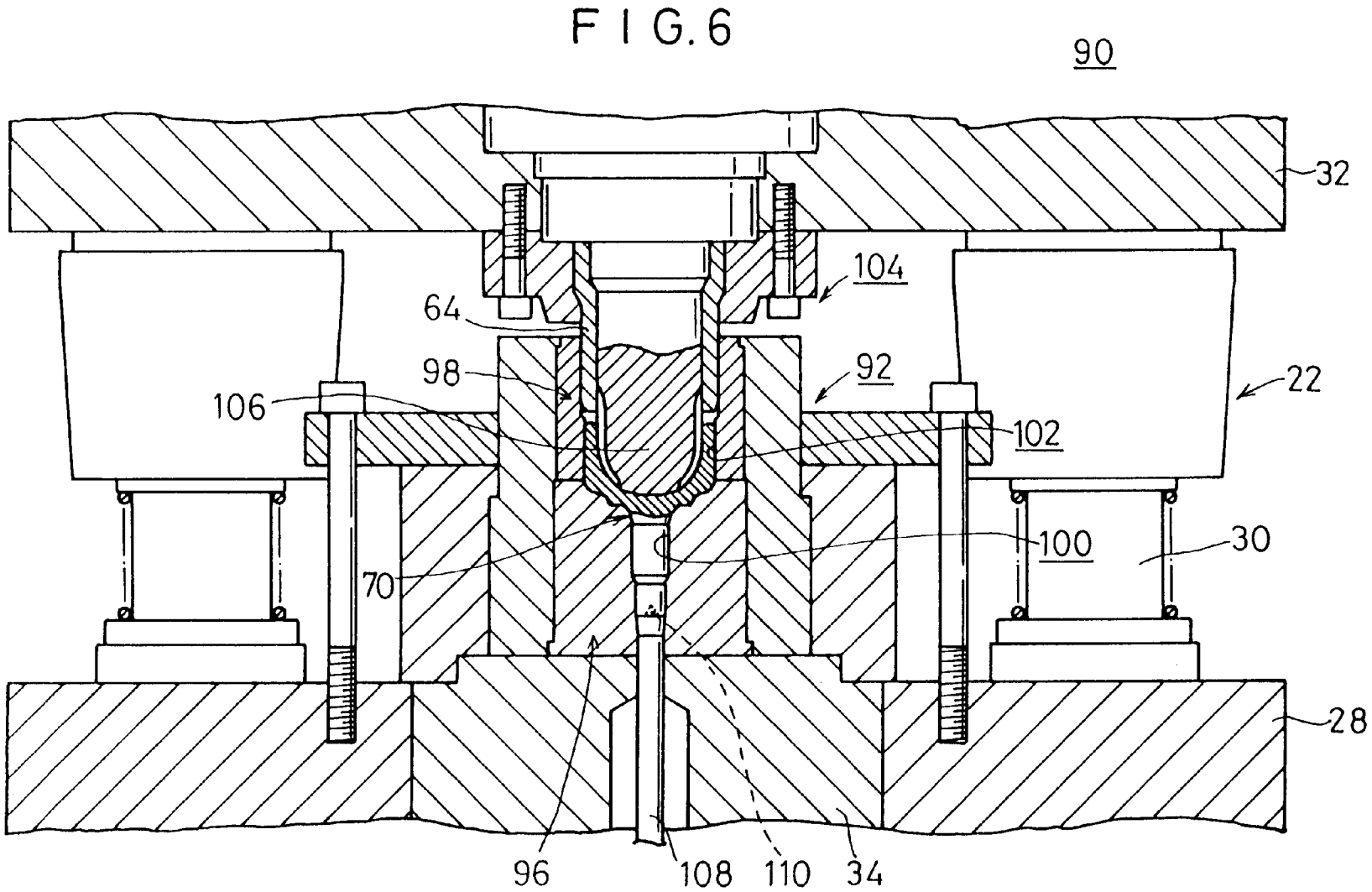
FIG. 6 is an illustrative vertical sectional view of the ironing apparatus especially when a final ironing process is completed by the ironing apparatus.

In the fourth step, the molded product 6*b* is arranged between the upper molding die 98 and the lower molding die 96 which form the ironing die apparatus 90 as shown in FIG. 3. Next, when the ironing punch 106 moves down, the shaft portion 4 is subjected to an ironing process again along the first cavity 100 of the lower molding die 96, while the cup portion 10 is subjected to an ironing process with respect to the inner peripheral surface thereof by the ironing punch 106 in a state in which the outer peripheral surface of the cup portion 10 is restrained over the range from the second cavity 102 of the upper molding die 98 up to the upper end of the first cavity 100. (refer to FIG. 6).

Figure 7B:
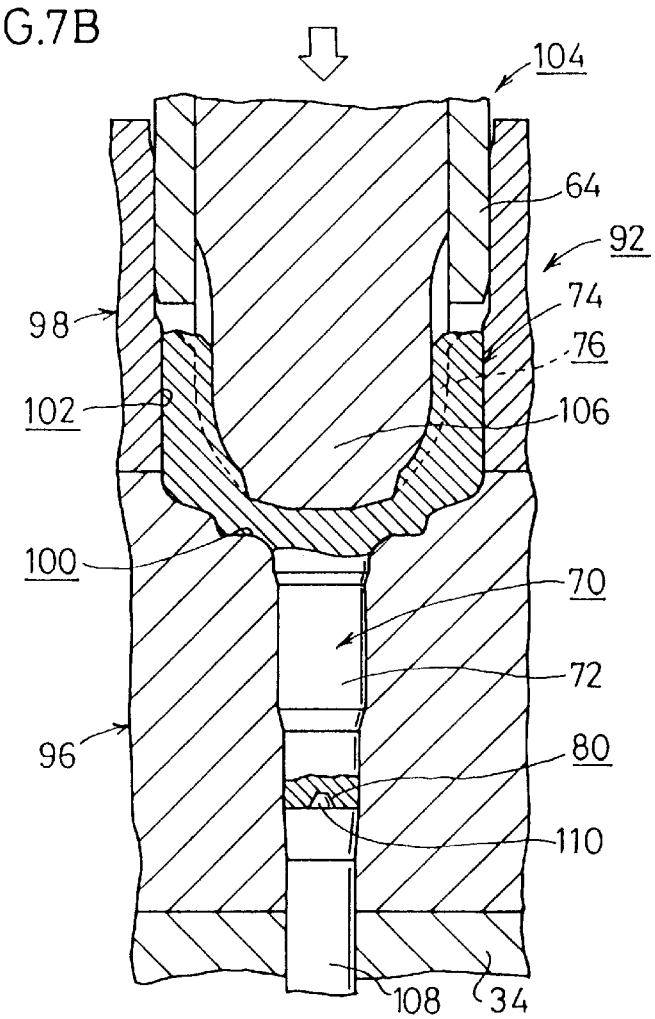
FIGS. 7A and 7B are views respectively illustrating how a cup portion of the outer ring member is shaped by an ironing punch.
Figure 7A:
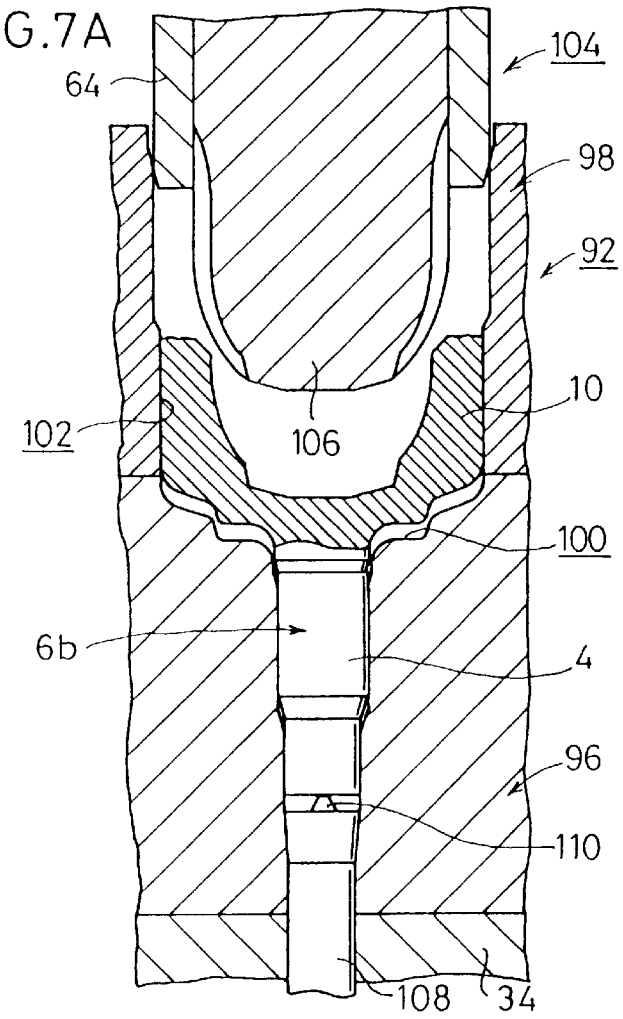
Figures 8A, 8B, 8C, 8D, 8E:
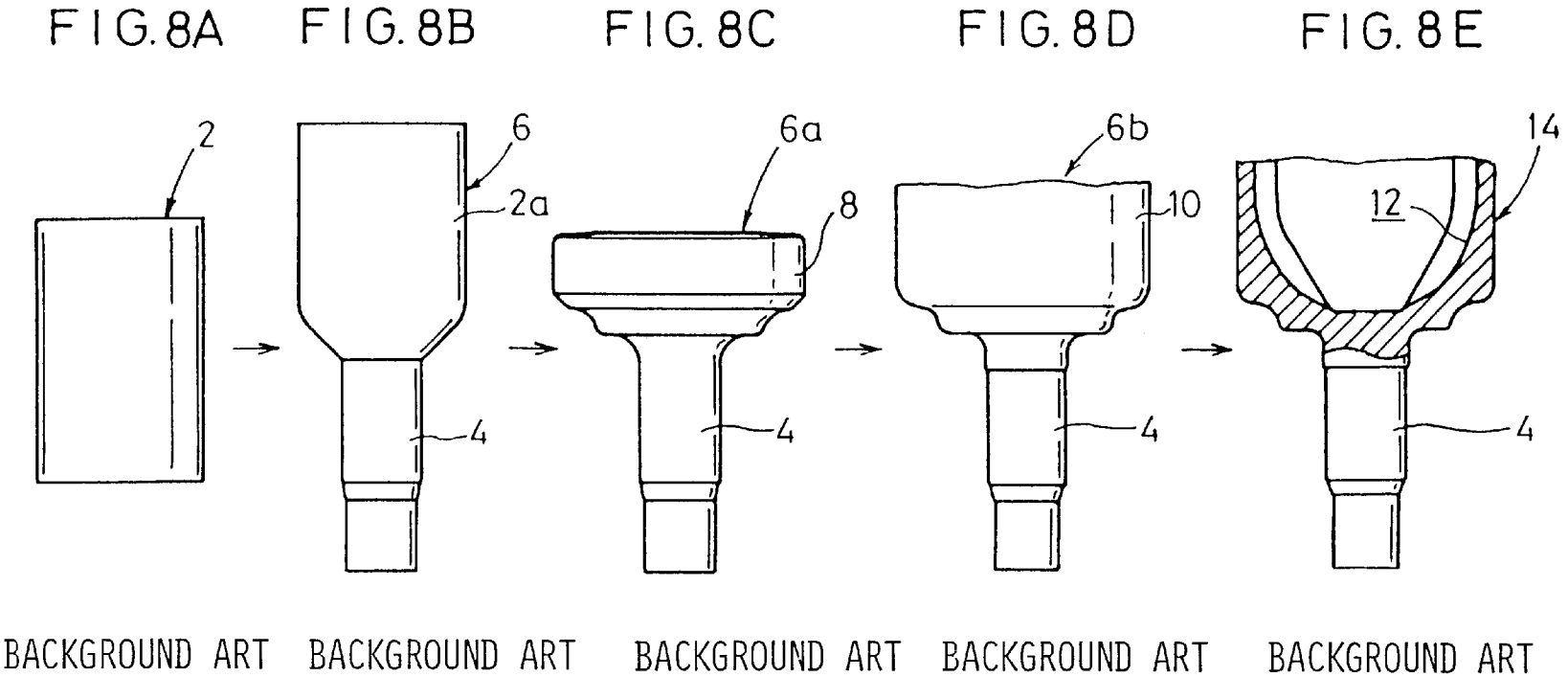
FIGS. 8A through 8E are views respectively illustrating processes for forming an outer ring member concerning the conventional technique.

In the above-described manner, according to the instant embodiment, a final ironing process is applied to the shaft portion 4 under the cooperative operation among the lower molding die 96, the upper molding die 98 and the ironing punch 106 while the inner peripheral surface of the cup portion 10 is subjected to an ironing process in a state in which the outer peripheral surface of the cup portion 10 is restrained. Accordingly, as shown in FIGS. 7A and 7B, due to the extruding action of the ironing punch 106, the ball grooves 76 are formed to a high degree of accuracy within the cup 74 of the outer ring member 70 and the accuracy of concentricity between the cup 74 and the shaft 72 can be securely obtained.

Thus, the grinding process for obtaining the roundness of the internal surface of the cup 74 and the accuracy of concentricity between the cup 74 and the shaft 72 is not required so that the number of processing man-hours is reduced once and for all with the effect that the manufacturing operation can be performed economically and efficiently. Further, since the ironing process is performed on the cup 74 while the outer surface of the cup 74 is kept restrained by the second cavity 102 and a part of the first cavity 100, the generation of a crack due to the distortion of the cup 74 can be reduced to a minimum.

Further, in order to securely maintain the accuracy of concentricity between the shaft 72 and the cup 74, it becomes possible to directly grind the outer surface of the cup 74 to provide a pulser fitting portion and also to directly grind the end surface of the rear of the cup 74 with ease. In addition, at the time of ironing by the ironing die apparatus 90, the punch 110 formed at the top end of the knockout pin 108 forms the central hole 80 in the end surface of the shaft 72. That results in the advantage that as compared to the conventional molding step of forming the central hole 80 after precision-finishing of the shaft 72, it is not necessary to provide an excess metal for the purpose of processing, and moreover, the operation of forming the central hole 80 can be performed at a stretch in a short time. It should be noted that although the instant embodiment has been described by way of the outer ring 70 forming part of a Birfield type constant velocity joint, the same effect can be obtained by using an outer ring forming part of a tripod type constant velocity joint.

As described above, in the case of the forge-molding method for forming an outer ring of a constant velocity joint according to the present invention, a final ironing process is applied through the first molding section of the shaft portion formed to have a final degree of product accuracy and the inner peripheral surface of the cup portion is subjected to an ironing process through the ironing punch in a state in which the outer surface of the cup portion is restrained by the second molding section of the cup portion formed to have a final degree of product accuracy. Consequently, the accuracy of the inner diameter of the cup portion can be effectively maintained and it is possible to securely obtain the degree of accuracy of concentricity between the cup portion and the shaft portion, whereby after the forge-molding the grinding process for obtaining the roundness of the inner peripheral surface of the cup portion and the grinding process for obtaining the accuracy of concentricity between the cup portion and the shaft portion can be dispensed with and the entire manufacturing operation can be efficiently and economically performed.

What is claimed is:

1. A forge-forming method for forming an outer ring of a constant velocity joint comprising a shaft and a cup formed integrally with and expanding radially and outwardly from one end of said shaft, which method comprises the steps of:

extrusion-molding a rod-shaped material to obtain a molded body having a shaft portion and a solid main body portion;

upset-molding the molded body so that the solid main body portion is crushed to form an upset portion;

extrusion-molding the upset portion to form a cup portion; and subjecting the shaft portion to a final ironing process through a stationary first molding section formed to have a final degree of product accuracy with respect to the shaft and ironing the inner peripheral surface of said cup portion by means of a displaceable ironing punch in a state in which the outer peripheral surface of said cup portion is restrained through a stationary second molding section positioned adjacent said first molding section and formed to have a final degree of product accuracy with respect to said cup, wherein said ironing punch is displaced into said stationary first and second molding sections to iron the inner peripheral surface of said cup portion.

2. The method of claim 1, and further comprising a step of moving said ironing punch toward and into said stationary first molding section in a state in which the outer surface of said cup portion is restrained through said stationary second molding section so that said shaft portion is subjected to an ironing process and at the same time, the inner peripheral surface of said cup portion is subjected to an ironing process.

3. The method according to claim 1, wherein a knockout pin is arranged concentric with said ironing punch, said knockout pin comprising a punching portion disposed on a top end thereof further comprising a step of forming a central hole in one end surface of said shaft portion, so that the central hole is formed through said punching portion at the time of ironing by said ironing punch.

* * * * *